US008381916B2

(12) United States Patent
Bossen

(10) Patent No.: US 8,381,916 B2
(45) Date of Patent: Feb. 26, 2013

(54) ROTARY AGGREGATE WASHING AND CLASSIFICATION SYSTEM

(76) Inventor: Paul W. Bossen, Mora, MN (US)

( * ) Notice: Subject to any disclaimer, the term of this patent is extended or adjusted under 35 U.S.C. 154(b) by 1116 days.

(21) Appl. No.: 11/420,472

(22) Filed: May 25, 2006

(65) Prior Publication Data

US 2006/0266676 A1 Nov. 30, 2006

Related U.S. Application Data

(60) Provisional application No. 60/685,632, filed on May 26, 2005.

(51) Int. Cl.
*B07B 1/22* (2006.01)

(52) U.S. Cl. ..... 209/288; 209/270

(58) Field of Classification Search ..... 209/270, 209/284–300
See application file for complete search history.

(56) References Cited

U.S. PATENT DOCUMENTS

| | | | | |
|---|---|---|---|---|
| 6,791 | A | 10/1849 | Von Schmidt | |
| 63,981 | A | 4/1867 | Aughinbaugh | |
| 103,825 | A | 6/1870 | Ball | |
| 106,049 | A | 8/1870 | George | |
| 161,160 | A | 3/1875 | Rutherford | |
| 189,882 | A | 4/1877 | Taylor | |
| 235,770 | A | 12/1880 | Hochstrate | |
| 324,159 | A | 8/1885 | Pfeil | |
| 402,845 | A | 5/1889 | Loughran | |
| 422,378 | A | 3/1890 | Clark | |
| 500,771 | A | 7/1893 | Lockhart | |
| 509,818 | A | 11/1893 | Lockhart | |
| 609,624 | A | 8/1898 | Nelson | |
| 619,341 | A * | 2/1899 | Postlethwaite | 209/270 |
| 763,019 | A | 6/1904 | Phinney | |
| 769,156 | A | 9/1904 | Everson | |
| 833,579 | A | 10/1906 | Chmeleff | |
| 849,614 | A | 4/1907 | Holmes | |
| 851,599 | A | 4/1907 | Latimer | |
| 973,363 | A | 10/1910 | Major | |
| 1,079,571 | A | 11/1913 | Mercer | |
| 1,178,126 | A | 4/1916 | Bodinson | |
| 1,183,805 | A | 5/1916 | Downerd | |
| 1,240,923 | A | 9/1917 | Bartley | |
| 1,319,665 | A | 10/1919 | Hudson | |
| 1,392,779 | A | 10/1921 | McManamen et al. | |

(Continued)

*Primary Examiner* — Joseph C Rodriguez
*Assistant Examiner* — Kalyanavenkateshware Kumar
(74) *Attorney, Agent, or Firm* — Albert W. Watkins

(57) ABSTRACT

An aggregate washing and classification system incorporates into a water-filled receptacle a sand classifier and one or more rotating augers. The augers are wrapped with screens or perforated walls that are fixed relative to the augers. The size of the perforations may be chosen to selectively sift particular sizes of gravel and rock, and if the perforations increase in size along the length of the augers, either continuously or discontinuously, the material which passes through the perforations will likewise increase in size with greater travel through the auger passageway. Consequently, a set of rock bins may be provided adjacent to the auger outlet, for collecting various sizes of larger aggregate, such as washed rocks. Sand will typically be permitted to pass through the screen perforations near the aggregate inlet. Once outside of the auger and screens, the sand will drop directly into a sand classifier, which is conveniently located directly below the augers and adjacent to the material inlet. Fresh water is pumped into the bottoms of the rock bins, and flows counter to the aggregate passing through the augers. The counter-flow keeps the rock bins clean, and the flow of water adjacent and counter to the material inlet is used to extract and discharge low-density matter from the aggregate inlet. The entire system is desirably incorporated into a single land vehicle for transport to aggregate sources, such as gravel pits and the like, where the finest grades of aggregate may be rapidly prepared.

20 Claims, 2 Drawing Sheets

U.S. PATENT DOCUMENTS

| | | | | | |
|---|---|---|---|---|---|
| 1,559,938 | A | | 11/1925 | Chance | |
| 1,645,603 | A | | 10/1927 | Loftus et al. | |
| 1,698,442 | A | | 1/1929 | Lockett | |
| 1,784,246 | A | | 12/1930 | Newton | |
| 1,917,300 | A | | 7/1933 | Hardinge | |
| 1,958,309 | A | | 5/1934 | Lockett | |
| 2,047,202 | A | | 7/1936 | Hardinge et al. | |
| 2,270,954 | A | | 1/1942 | McCloud et al. | |
| 2,276,539 | A | | 3/1942 | Finney | |
| 2,373,662 | A | | 4/1945 | Dickson | |
| 2,428,789 | A | | 10/1947 | Dickson | |
| 2,429,436 | A | | 10/1947 | Walker | |
| 2,450,980 | A | | 10/1948 | Moyer | |
| 2,468,005 | A | | 4/1949 | Walker et al. | |
| 2,491,912 | A | | 12/1949 | Walker | |
| 2,521,152 | A | | 9/1950 | Davis | |
| 2,559,403 | A | | 7/1951 | Cover | |
| 2,711,250 | A | * | 6/1955 | Clark | 209/291 |
| 2,836,299 | A | | 5/1958 | Johnson | |
| 2,919,808 | A | | 1/1960 | Hilkemeier | |
| 2,983,378 | A | | 5/1961 | Hilkemeier | |
| 3,262,560 | A | | 7/1966 | Lillig et al. | |
| 3,746,164 | A | | 7/1973 | Culp | |
| 3,815,737 | A | | 6/1974 | Katter | |
| 3,865,727 | A | * | 2/1975 | Broling et al. | 210/162 |
| 3,886,063 | A | * | 5/1975 | Friesz | 209/44 |
| 4,012,316 | A | | 3/1977 | Ostlund et al. | |
| 4,159,242 | A | * | 6/1979 | Walker | 209/44 |
| 4,207,176 | A | | 6/1980 | Hood | |
| 4,207,943 | A | * | 6/1980 | Gardner et al. | 165/89 |
| 4,267,980 | A | * | 5/1981 | LaPoint | 241/20 |
| 4,290,527 | A | | 9/1981 | Wright | |
| 4,585,547 | A | | 4/1986 | Nicholson | |
| 4,717,470 | A | * | 1/1988 | Apeland | 209/17 |
| 4,898,665 | A | | 2/1990 | Lamort | |
| 4,901,863 | A | * | 2/1990 | Lancaster | 209/664 |
| 5,370,236 | A | | 12/1994 | Wallace et al. | |
| 5,507,396 | A | * | 4/1996 | Hauch | 209/399 |
| 5,535,891 | A | * | 7/1996 | Kuniyone et al. | 209/12.1 |
| 5,628,912 | A | * | 5/1997 | Nesseth | 210/768 |
| 5,957,301 | A | * | 9/1999 | Wedel et al. | 209/173 |
| 6,006,921 | A | * | 12/1999 | Zehr | 209/288 |
| 6,561,359 | B2 | | 5/2003 | Egge et al. | |
| 6,874,713 | B2 | * | 4/2005 | Arvidson et al. | 241/1 |

* cited by examiner

ROTARY AGGREGATE WASHING AND CLASSIFICATION SYSTEM

CROSS REFERENCE TO RELATED APPLICATIONS

This application claims priority to U.S. provisional patent application Ser. No. 60/685,632 filed May 26, 2005 and of common title and inventorship, the contents which are incorporated herein by reference in entirety.

BACKGROUND OF THE INVENTION

1. Field of the Invention

This invention pertains to classifying, separating, and sorting solids generally, and more specifically in one manifestation to a device using aqueous suspension, sifting, and stratifying to wash and classify aggregate.

2. Description of the Related Art

Cleaning and classifying aggregate matter is an old technology with many applications in modern society. A primary application is in the production of suitable aggregate for the fabrication of high-quality concrete products. As is known in the concrete industry, many characteristics of concrete can be greatly enhanced through the addition of appropriate aggregate materials. The aggregate additives are incorporated in relative quantities based upon particular size ranges, so that a typical mix will include some combination of both sand and one or more sizes of larger stones. Through appropriate size and even shape selection, the concrete can be designed to have the best characteristics for a given application.

However, in order for the aggregate additives to provide the intended benefits without undesirable disadvantages, the aggregate needs to be both clean and properly classified into size ranges. Humus, clay, wood and paper, and even softer and lower density rock such as shale can very adversely affect the performance of a concrete product. These undesirable materials can deleteriously alter such characteristics as compression strength, spalling, and wear or abrasion resistance, chemical resistance, and other characteristics. Consequently, it is very desirable to remove such materials prior to the aggregate matter being incorporated into a concrete mix.

There are many additional applications for washed and classified aggregate, including but not limited to road, building and other construction, landscaping, mining, sand blasting and casting, and even filtration. The different applications may have more or less stringent requirements for both size ranges and cleanliness of product, which may often vary not only by the application, but also by a given job requirement. Consequently, while aggregate for concrete mixes are discussed for exemplary purposes herein, it will be understood that other applications are contemplated as well.

In order to produce suitable aggregate, many facilities depend entirely upon large agitated screens. These screens will typically be loaded with a quantity of aggregate mix, and then shaken or vibrated relatively violently. Matter which is smaller than the screen opening will pass through the screen, where it will typically be caught upon the next screen, which will normally have an even smaller opening size. With sufficient agitation, all of the smaller particles will pass through the screen, while the larger particles will be blocked by the screen. By cascading several screens, it is possible to classify the aggregate mix into particular rock and gravel sizes. Unfortunately, this approach generates a great deal of dust during the agitation of the screens, and so water sprays are often used to keep the dust down. In some instances, the water spray may also assist with the removal of silt or humus, though quite frequently it will be desirable to keep the mist fine and light enough to only serve as dust control. More water may actually interfere with the screening, and may permit clay, for exemplary purposes and not limited thereto, to stick directly to desirable rock. Consequently, without a full washing, the spray can interfere with the separating process. As a result, the classified aggregate produced by this method tends to be relatively dirty, and may require further washing for the more demanding applications.

The use of a water mist also limits the environment where the apparatus may be applicable. As residents of northern climates will recognize, it is not practical to spray a mist during colder, sub-freezing weather. Consequently, the mist dust control is dependent upon warmer weather, undesirably limiting the screening and classifying to the warmer seasons. Further, the mist will rapidly evaporate from the surfaces of the aggregate. This evaporation may lead to very undesirable losses in the very arid climates, again limiting the application and generally preventing misting in arid climates or during times of drought. Since sensitivity of machinery to weather is almost always disadvantageous, causing interruptions in work projects and disruption of schedules, it is consequently desirable to reduce the sensitivity of the apparatus to climate.

Because the screens rely upon lifting and dropping of the aggregate upon the screen, the process requires substantial machinery to have high throughput of matter. In other words, it takes a great deal of energy to repetitively lift and drop the aggregate, and that in turn means large motors and strong frames and supports. Moreover, the extra energy is usually dissipated in the screens, resulting in substantial erosion of the screens and frequent replacement.

Yet another drawback of the agitated screen is the inability of the process to separate out the hardness or density of the materials being sifted. In other words, it is difficult to separate wood and sticks from rocks, and also low-density rocks such as shale from higher density harder rocks. Consequently, when using a sifting process, a separate and additional machine and process is required to further clean and separate undesirable matter.

SUMMARY OF THE INVENTION

Exemplary embodiments of the present invention solve inadequacies of the prior art by providing a rotary screen with counter-flowing water. The water may be either fresh, or filtered on site using a filter, sedimentation pond or other suitable means. With appropriate design, a sand classifier may be integrated directly into the apparatus, and cooperate with the rotary screen and counter-flowing water. The design may be either fixed or mobile, and when mobile provided with a wheel-set such as a trailer, or be provided as a fully functional vehicle.

In a first manifestation, the invention is a rotary aggregate washing and classification system. The system comprises in combination a material inlet for receiving material therein, a reservoir containing a fluid therein, at least one screen mesh, and a sand classifier within the reservoir. The at least one screen mesh has at least one screen opening size, is coupled to the material inlet suitably to receive material therefrom, and passes at least partially through the reservoir, thereby forming a passage for material smaller than the at least one screen opening size to pass through while larger material is prevented from passing through. The at least one screen mesh is operative to separate larger material from smaller material. The sand classifier is located within the reservoir and receives smaller material after the smaller material passes through the at least one screen mesh and is cooperative with a flow within the fluid and with smaller material, to grade smaller material into at least two coarseness increments.

In a second manifestation, the invention is an aggregate washing and classification system. In the system, a material inlet receives material. A reservoir contains a fluid. At least one screen mesh has at least one screen opening size, and is coupled to the material inlet suitably to receive material therefrom. The screen mesh passes at least partially through the reservoir, and thereby forms a passage for material smaller than the at least one screen opening size to pass through while material larger than the at least one screen opening size is prevented from passing through, whereby the at least one screen mesh is operative to separate larger material from smaller material. At least one rock bin has a top which receives graded material that has passed through the at least one screen mesh, a bottom, a fluid inlet distal from the rock bin top, a fluid discharge adjacent the rock bin top, and a means to discharge graded material from the rock bin to a location external to the rotary aggregate washing and classification system. The rock bin at least temporarily stores rocks therein and also conducts fluid received at the fluid inlet to the rock bin top for discharge therefrom.

In a third manifestation, the invention is a method of washing and sorting aggregated materials to separate useful rocks and sands from debris. According to the method, aggregated materials are introduced through a passageway inlet into a passageway at least partially defined by a perforated wall and at least partially flooded with a fluid contained in a receptacle. A first fraction of aggregated materials is separated from a second fraction by passing the first fraction through the perforated wall, while retaining the second fraction within the passageway. The second fraction of aggregate materials is moved within the passageway to a passageway discharge distal to the passageway inlet. The first fraction of aggregate materials is transferred into a temporary storage bin. The temporary storage bin is streamed with a relatively purer fluid than passageway fluid. The relatively purer fluid stream is then conducted from temporary storage bin to passageway discharge and into the passageway, thereby washing impurities from the first fraction of aggregate materials into the passageway fluid.

OBJECTS OF THE INVENTION

A first object of the invention is to provide an efficient and effective method and apparatus for washing and classifying an aggregate. A second object of the invention is to remove as much undesirable matter from an aggregate mix as reasonably possible. Another object of the present invention is to quickly and efficiently classify the aggregate mix into appropriate size ranges. An ancillary object is to permit release of relatively precise proportions of the various size ranges, to facilitate the formation of an aggregate mix to specification. A further object of the invention is to perform the desired washing and classification with high throughput, while not requiring as large a machine as was heretofore needed and while keeping wear to a minimum. An additional object of the invention is to reduce sensitivity to the environment, to permit the machine to operate at lower temperatures and in water-scarce areas. Yet another object of the present invention is to enable the apparatus for washing and classifying to be portable without significant disassembly or labor, such that the apparatus may readily be transported as a trailer or load upon a vehicle from location to location.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
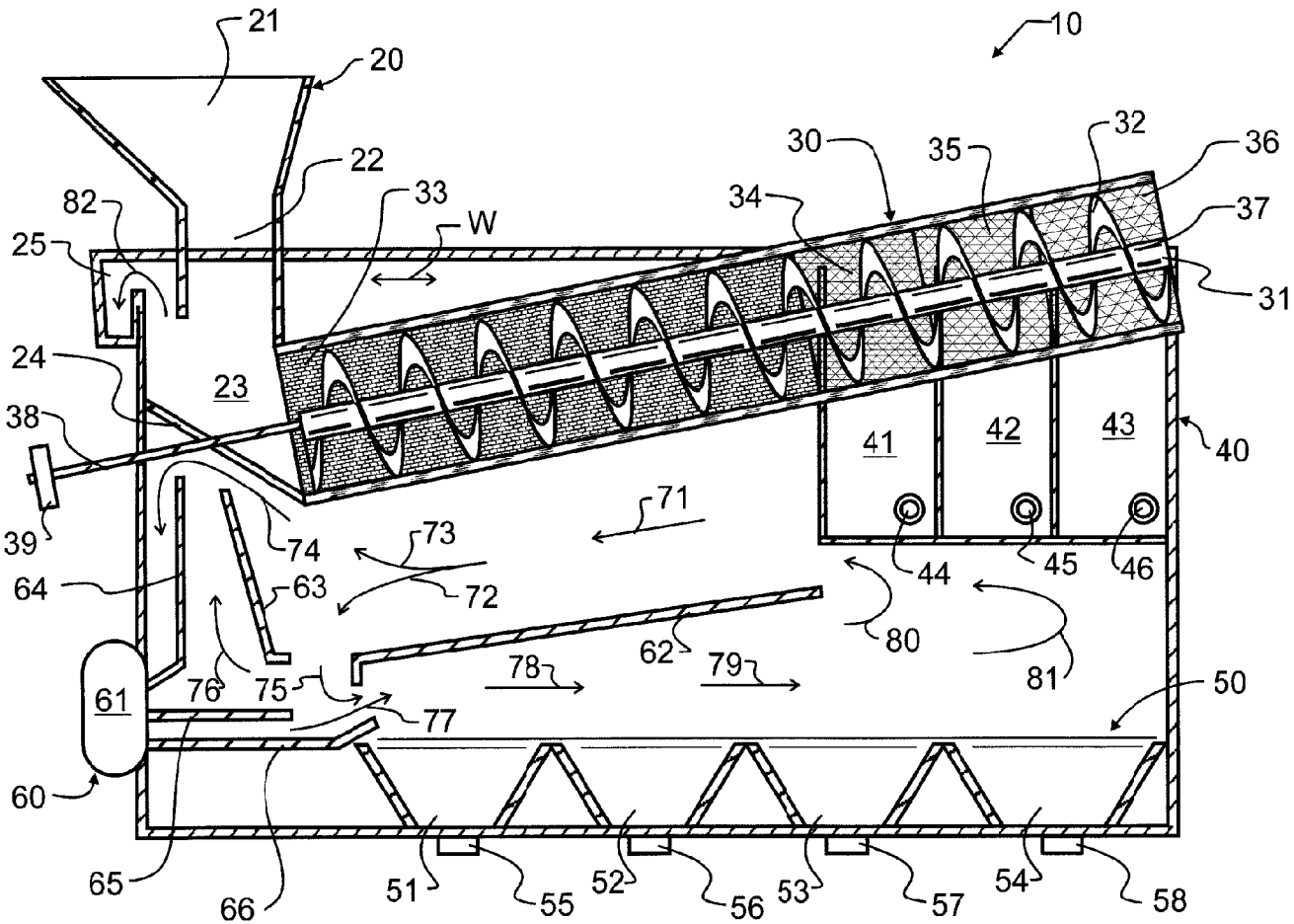
FIG. 1 illustrates a first preferred embodiment rotary aggregate washing and classification system designed in accord with the teachings of the present invention from side sectional view.

Manifested in the preferred embodiment of the invention illustrated in FIG. 1, the present invention provides a rotary aggregate washing and classification system 10 which is operative to receive, wash and separate aggregate into useful components and waste. Aggregate, as is known in the industry, may typically include not only rock, gravel and sand but may also contain contaminants such as wood, leaves, paper, plastic, shale, clay, and other undesirable constituents. Most desirably, the undesirable constituents will be separated from the rock, sand and gravel. The rock, gravel and sand will each be further separated into size classifications, for later use as is known in the industry.

Rotary aggregate washing and classification system 10 is comprised by several main components. These include inlet 20, rotary screen and auger 30, rock receiver 40, sand classifier 50, and water flow control 60. Inlet 20 is operative to receive aggregate in an "as-delivered" state, which may come directly from an adjacent gravel pit, or which may be delivered from a distance, such as by truck or rail. As will be described herein below, one of the advantages of the present invention is the mobility which is inherent. The preferred rotary aggregate washing and classification system 10 may be readily transported from location to location, thereby facilitating the processing of aggregate from smaller gravel pits without requiring the aggregate to be transported to another processing facility. Consequently, in many instances the source for aggregate passing into inlet 20 will be a loader, shovel or other equipment within the gravel pit. Depending upon the quality and size of the source matter, in some cases the matter may be passed through a crusher prior to introduction into inlet 20. To better control the rate of feed into inlet 20, it may also be desirable to meter the source matter onto a conveyor belt or the like, or use other suitable means to maintain a steady feed of source matter into inlet 20. Finally, it may also be desirable to add water into either the aggregate or to inlet 20 together with the aggregate, which will assist with ensuring proper flow of matter without undesirable clogging.

Aggregate is first received within aggregate inlet funnel 21, and then passes into a narrower neck region 22. At the lower end of neck region 22, the aggregate will first be exposed to water within rotary aggregate washing and classification system 10, which will desirably be maintained at a level illustrated in the figures as water line W. The aggregate will then continue to drop into holding region 23, prior to passing into rotary screen and auger 30. A sloped infeed surface 24 helps to ensure gravity-driven automatic feeding into rotary screen and auger 30. In operation, the primary water outlet for water that has passed through rotary aggregate washing and classification system 10 is water outlet 25. As will be described in more detail herein below, fresh water is pumped into rotary aggregate washing and classification system 10 through water inlets 44-46, and may circulate an indeterminate number of times within rotary aggregate washing and classification system 10. The water will ultimately pass out of water outlet 25. Since water outlet 25 is located immediately adjacent to aggregate inlet funnel 21, as aggregate passes through neck region 22 into submersion, lighter materials such as wood, leaves, paper and other undesirable trash will float up and eventually pass into water outlet 25 with water flow 82. In addition, materials such as very fine silt which remain fully suspended in the water will also be carried out with flow 82. With appropriate flow rates and patterns, even matter closer in density to the desired sand, rock and aggregate product may be separated at the inlet, including such matter as shale and clay.

Most preferably, inlet 20 will never be fully filled, as this might undesirably trap lighter materials in the aggregate. Instead, turbulence within water adjacent to neck 22 is often quite desirable, which will assist with the separation of materials which float. Specific arrangements of in-feed belts carrying matter, feed and flow rates, and other factors may be adjusted to optimize a given apparatus for a particular source matter, to most efficiently process that material.

Aggregate, which has now desirably been separated from wood, paper, leaves and the like, will next be drawn into rotary screen and auger 30 from adjacent holding region 23. In operation, motor 39 will drive and rotate shaft 38 relative to the outer wall of rotary aggregate washing and classification system 10. Shaft 38 is in turn coupled to auger shaft 37, which carries auger 32, such as an Archimedes screw, thereon. Supported circumferentially about auger 32 are a set of screens 33-36, which get progressively coarser as aggregate passes from holding region 23 to the eventual rock outlet 31. Support for auger 32 and screens 33-36 may include various types of known and suitable bearings.

Screens 33-36 will most preferably be manufactured from a durable and abrasion resistant material such as, but not limited to, polymers and various metals and metal-alloys, either plated or unplated, and coated or otherwise. In one preferred embodiment, screens 33-36 may be fabricated from expanded metal, which may be coated, plated or otherwise protected from corrosion and wear, such as with a polyurethane, PVC or any other suitable material. Further, in the case of the expanded metal and with other materials as suitable and desired, it is known that the forming process causes the metal to twist out of the plane of the web of metal. So, small segments of the metal are each angularly offset from tangent about the center, each small segment offset in the same direction. In this special case, it may be further desired to orient the angular offset such that it approaches a vertical angle sometime after passing through the six o'clock position, such as when approximately adjacent to the seven or eight o'clock position, when viewed from rotational axis and when rotating in that view clockwise. While not being bound to a particular theory, this is believed to permit the appropriately sized and cleaned product to drop through the screen as the aggregate is being lifted against the force of gravity, where otherwise the angular offset would tend to hold material into the screen during the upward movement of the screen.

Rotary motion is coupled from auger shaft 37 through any suitable means to auger 32 and screens 33-36, such as one or more stub shafts or the like that, for exemplary purposes only and not limited thereto, may extend radially between auger shaft 37 and either or both auger 32 and screens 33-36. The benefit of a relatively small axial auger shaft 37 is that it provides strength and rigidity in the axial direction, while, if smaller than the inner diameter of auger 32, permitting flow of water through the center of auger 32. This flow of water directly through the core, which may be counter to the direction of aggregate movement, is preferable for some applications.

Auger 32 is rotated by the action of motor 39, as already described, and will in turn carry aggregate through rotary screen and auger 30 from adjacent holding region 23, gradually raising the aggregate to levels closer to and eventually above water line W. In this way, any rocks large enough to avoid passing through final screen 36 will finally be dropped out of open end 31. Such larger rocks may be sorted further if desired, but in some instances will alternatively be passed through a crusher or the like, and then the resulting aggregate will once again be introduced back into aggregate inlet funnel 21. While only one rotary screen and auger 30 is illustrated, it will be apparent to those reasonably skilled in the art that a plurality of rotary screen and auger units may be combined in one machine, or that a plurality of separate augers 32 may be provided within a common, circumscribing screen. Furthermore, the direction of rotation of the augers, either individually or with respect to each other, is not critical to the operation of the invention, so long as the material is satisfactorily transported, as is known in the material handling arts. Consequently, the augers may be either counter-rotating or rotating in the same direction.

As the aggregate traverses rotary screen and auger 30, sand and gravel will pass through screen 33, while the smallest rock will not be dropped out until encountering screen 34. Generally circumscribing the lower side of screen 34 is the first of three rock chambers 41-43 within rock receiver 40. These chambers are used to collect and store the rocks, until later discharged through a side or bottom door (not illustrated). In one conceived embodiment, each separate rock chamber will further be provided with a false bottom, a scale monitoring the load upon the false bottom, and electrical controls, to permit both monitoring of the fill levels within each rock chamber, and also to permit discharge of selected amounts of rock therefrom through automated or computer control.

As an alternative to the use of doors or gates, it is further contemplated herein that additional augers may be provided which couple into one or more of the chambers 41-43. These additional augers may be used to remove product from the chambers when desired, such as through a proportional metering, or may alternatively be operative continuously to discharge the product. The augers, including rotary screen and auger 30, may also be provided with scoops at the ends thereof to couple product into slides, chutes or the like, as may be desired.

Along the bottom of rotary aggregate washing and classification system 10 is a preferred sand classifier 50, which has a number of funnels 51-54 and associated outlets 55-58 which are used to selectively release sand therefrom. Once again, outlets 55-58 may be replaced by, or additionally provided with discharge assists such as additional augers, chutes and skids, or other suitable apparatus, similar to that already discussed with regard to chambers 41-43. Operation of sand classifier 50 is provided by water flow control 60, which controls the flow of water within rotary aggregate washing and classification system 10 to operate sand classifier 50 in a manner such as is known in the prior art as a horizontal flow, gravitational separator.

Sand passing through finer screen 33 will drop into a water flow stream having a flow direction illustrated by arrow 71, and limited by baffle 62. As the water and sand approach baffle 63, the water flow will divide, as shown by arrows 72 and 73, with flow 72 carrying most of the larger sand and gravel. Finer silt that remains suspended will be carried within flow 74 or flow 76 to an inlet to pump 61 defined by baffle 64. The outlet for pump 61 is defined by flow 77, which will be greatly accelerated relative to the other adjacent flow path. This acceleration will carry not only flow path 77, but also gravel suspended within flow 75, horizontally along flow path 78, passing over funnels 51-54 in order. Larger gravel will drop first, falling into funnel 51, with finer gravel being carried into funnel 52. Since baffle 62 has a slight slope, flow 79 will be moving slower than flow 78 was. As a result of the gradual deceleration of flow farther from pump 61, and the continued action of gravity on the more dense sand within the water, progressively finer materials will continue to drop from the flow as the flow continues. Adjacent flow 79, there will be a slight and slow eddy 81 developed, which will tend to drop the most fine sand, and there will also be a return flow 80 which forms a confluence with flow 71.

In addition to the flow generated by pump 61, a second flow is produced by the introduction of water through inlets 44-46. This fresh water serves to not only continue to keep rocks within chambers 41-43 clean and fresh, but also generates a flow of water which is counter to the direction of movement of aggregate within rotary screen and auger 30. This counter flow serves to prevent silt from passing into rock chambers 41-43 with the aggregate, and additionally moves the lighter materials in the direction of water outlet 25. The general flow of water from inlets 44-46 towards water outlet 25 will also couple with flow 71, and is encouraged to do the same by turbulence generated by auger 32. As a result of this turbulence, there is a certain amount of mixing of water circulating through sand classifier 50 and water circulating through rotary screen and auger 30.

Most preferably, auger 32 will have a variable pitch, which may be varied in discrete steps or may be continuously varied. Most preferably, adjacent finer screen 33 auger 32 will move material more quickly towards outlet 31. Adjacent each progressively coarser screen 34-36, auger 32 will move material more slowly towards outlet 31, to where, adjacent outlet 31 and screen 36, any remaining rock is tumbled more, while traveling the least towards the outlet. One consideration in the design of the variable pitch is the consideration of the amount of active screen. For example, if the initial aggregate is comprised of 80 percent fine sand which passes through screen 33, than the initial screen 33 will have 80 percent of the received material actively passing through at a given moment. However, as the aggregate progresses towards the outlet, less of the fine sand remains, reducing the amount of active screen surface, and thereby requiring more time for removal. As an adjunct to this principle, it is recognized herein that the screens may be varied in surface area, diameter, and even geometric outline to better optimize performance for a particular source material having particular size range or other characteristic that affects the proportion of processing times needed for a given stage.

Figure 2:
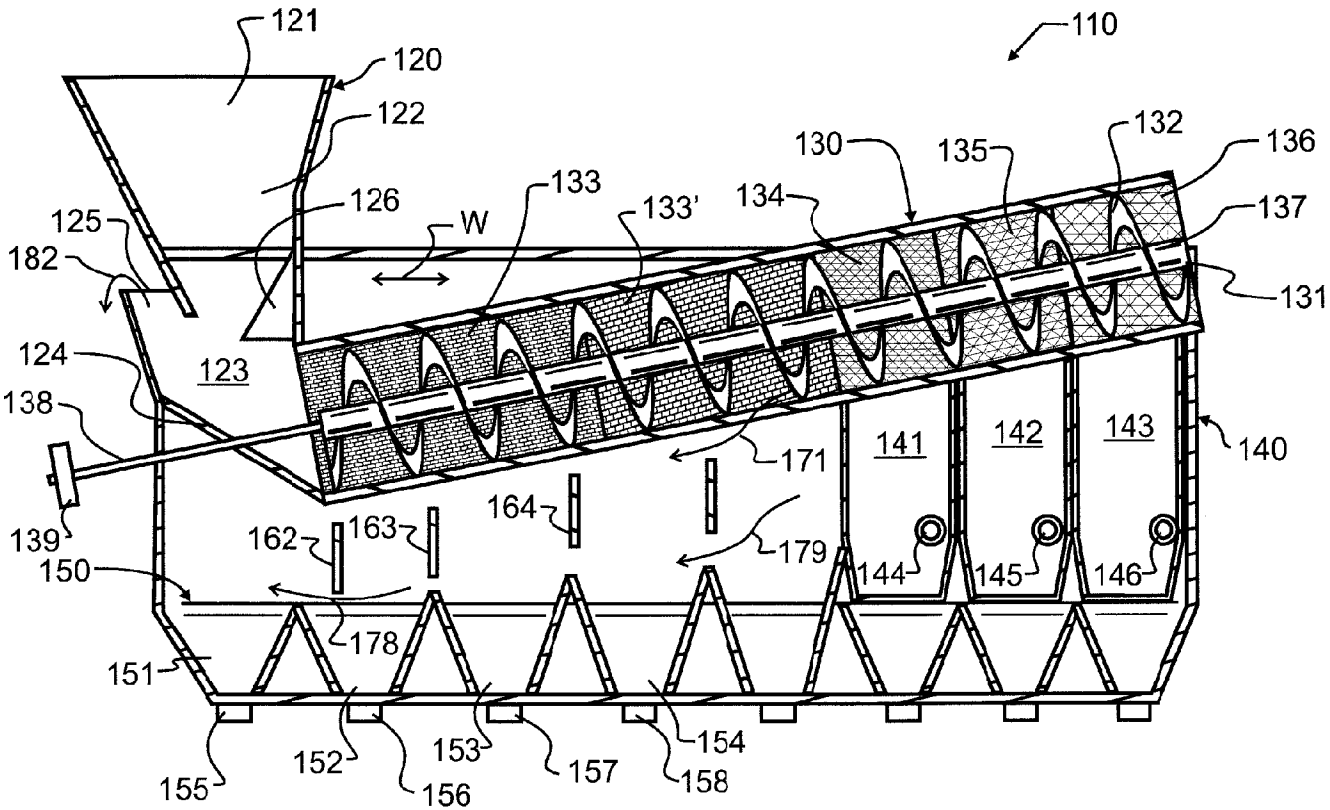
FIG. 2 illustrates a second preferred embodiment rotary aggregate washing and classification system designed in accord with the teachings of the present invention from side sectional view.

FIG. 2 illustrates a second preferred embodiment rotary aggregate washing and classification system 110. Where possible, like numbers have been used which have the same digits in the tens and ones places as those numbers which correspond to like elements in FIG. 1. So, for example, aggregate inlet funnel 121 in rotary aggregate washing and classification system 110 performs similar function to aggregate inlet funnel 21 in rotary aggregate washing and classification system 10. This numbering is preferentially used, and where functions are alike or similar enough, no further discussions are provided herein for brevity.

As may be seen in FIG. 2, a special baffle 126 is provided within neck region 122 which serves to deflect aggregate away from the entrance to rotary screen and auger 130, and instead towards water outlet 125. This deflection enhances the shear and separation of lighter materials. When properly designed, and when accompanied by automated aggregate feeders such as belt feeders that load aggregate into inlet 120, special baffle 126 will provide sufficient assist to enable the separation of shale and the like within inlet 120, for discharge directly out of water outlet 125.

A second difference between rotary aggregate washing and classification system 10 and rotary aggregate washing and classification system 110 is found in the circulation of water therein, and the placement and orientation of baffles therein. As can be seen in FIG. 2, vertical baffles 162-164 (and beyond) are provided. Water flow remains in the direction of rock receiver 140 to outlet 125, similar to that of FIG. 1, above vertical baffles 162-164. However, below these baffles, water flow is reversed between the two preferred embodiments. More particularly, in rotary aggregate washing and classification system 110, water will flow from rock receiver 140 along a flow 171 above vertical baffles 162-164. Below vertical baffles 162-164, water also flows parallel in direction to flow 171, this time along flow 178. Vertical baffles 162-164 prevent the turbulence created by rotation of auger 132 from interfering with proper vertical dropping of sand and aggregate from rotary screen and auger 130. In this embodiment, more screen sizes will preferably be provided adjacent inlet 120, shown as 133 and 133'. While only two screens are illustrated, it will be understood herein that only one or more than two may be provided, with no limit on the number other than that which is economically justified and on the desired ultimate length of rotary aggregate washing and classification system 110. The finest material will still be carried along flow 178 around vertical baffle 162, and will drop into funnel 151.

It should now be apparent that while a single funnel 151 is illustrated for collection and recovery of finer sand, rotary aggregate washing and classification system 110 may be extended as desired to permit placement of additional baffles and funnels to the left of funnel 151 shown in the figure. In such case, everything under and including rotary auger 130 would remain as illustrated. However, holding region 123 would be enlarged to the left, along the longitudinal axis of rotary aggregate washing and classification system 110. Additional funnels similar to funnel 151 would then be provided thereunder, permitting any number of classifications to be made therein, limited only by the ultimate length chosen for rotary aggregate washing and classification system 110. Since rotary aggregate washing and classification system 110 will most preferably be transportable along a roadway, such length will be determined by the size and weight restrictions placed upon the roadways for a given locale.

Since the flow of water within rotary aggregate washing and classification system 110 is generally opposite the movement of aggregate, and is unidirectional, fresh water must be continually provided at water inlets 144-146, and will continually be taken from water outlet 125. While it is conceivable in certain environments and climates to draw from a clean fresh water source such as a lake, pond, reservoir, or even flooded quarry, in other instances it will be preferable to provide a separate holding pond or tank exterior to rotary aggregate washing and classification system 110, into which effluent from flow 182 will pass, and be allowed to settle. In turn, such holding tank or pond will then be drawn from, at different location, to pump back into water inlets 144-146. In yet a third conceived alternative, in some instances it may still be preferred to provide a recirculating pump similar to pump 61 of FIG. 1. In this instance, the recirculating pump will most preferably draw adjacent to motor 139, and pump the water back into flow 179 adjacent rock chamber 141.

A third significant change between the two embodiments is found in rock receiver 140. As shown in FIG. 2, rock receiver 140 includes three separate and free-standing rock chambers 141-143, each which are preferably supported upon a scale, thereby keeping the chambers separate from fixed components within rotary aggregate washing and classification system 110. Consequently, the weight of each may be measured independently, and so the amount of aggregate located therein may be determined. With this configuration, these rock chambers 141-143 may be devised to unload from the bottom into and through the underlying funnels. Once again, the amounts present, fill levels, and unloading may all be automatically or numerically controlled.

As discussed herein above, rotary aggregate washing and classification system 10 may be supported upon a wheel set, together with a base which may be used as a stand once rotary aggregate washing and classification system 10 is transported to a point of use. As mentioned herein above, most preferably rotary aggregate washing and classification system 10 is designed to be mobile. Transport will most preferably occur when rotary aggregate washing and classification system 10 is either nearly or completely empty, thereby reducing the weight upon a roadway and hazards associated with a heavy load. With the preferred configurations, each of the rotary aggregate washing and classification systems 10, 110 may be fully unloaded relatively easily prior to transport, simply by emptying each of the sand and rock funnels.

While the foregoing details what is felt to be the preferred embodiment of the invention, no material limitations to the scope of the claimed invention are intended. Further, features and design alternatives that would be obvious to one of ordinary skill in the art are considered to be incorporated herein. For exemplary purposes only, and specifically not limited solely thereto, rotary auger 130 is illustrated as being tilted slightly with respect to the top of rock receiver 140 and the water level W. However, rotary auger 130 could alternatively be fabricated to be parallel with the top of rock receiver 140, and the entire rotary aggregate washing and classification system 110 could then be tilted to achieve the same effect. Consequently, the scope of the invention is set forth and particularly described in the claims herein below.

I claim:

1. A rotary aggregate washing and classification system, comprising in combination:

a material inlet for receiving material therein;

a reservoir containing a fluid therein;

at least one tubular screen mesh having at least one screen opening size, and coupled to said material inlet suitably to receive said material therefrom, and passing at least partially through said reservoir, and thereby forming a passage for material smaller than said at least one screen opening size to pass through while material larger than said at least one screen opening size is prevented from passing through, whereby said at least one screen mesh is operative to separate larger material from smaller material;

an auger within said at least one screen mesh which is operative to carry said material against the force of gravity through said at least one screen mesh; and a sand classifier within said reservoir receiving said smaller material subsequent to said smaller material passing through said at least one screen mesh into a flow within said fluid, said flow initially transporting said smaller material in entirety and having decreasing velocity subsequent to receiving said smaller material, gravitational forces acting upon said smaller particles to grade said smaller material into at least two receptacles having coarseness increments generally inversely proportional to an amount of time said smaller material is suspended in said flow.

2. The rotary aggregate washing and classification system of claim 1, wherein said at least one screen mesh is tubular and rotates about a screen mesh axis of rotation, and said sand classifier is cooperative with said fluid flow traveling generally parallel to said screen mesh axis of rotation and in a direction aggregate travels within said at least one screen mesh to grade said smaller material into said at least two coarseness increments.

3. The rotary aggregate washing and classification system of claim 1, wherein said at least one screen mesh is tubular and rotates about a screen mesh axis of rotation, and said sand classifier is cooperative with said fluid flow traveling generally parallel to said screen mesh axis of rotation and in a direction opposed to aggregate movement within said at least one screen mesh to grade said smaller material into said at least two coarseness increments.

4. The rotary aggregate washing and classification system of claim 1, wherein said at least one screen mesh comprises expanded metal.

5. The rotary aggregate washing and classification system of claim 4, wherein said at least one screen mesh expanded metal has an irregular surface that is at intervals angularly offset from tangent to a circle concentric about said screen mesh axis of rotation, to more readily pass said smaller material during a lifting of said smaller material than during a lowering of said smaller material.

6. The rotary aggregate washing and classification system of claim 1, wherein said at least one screen mesh comprises at least two distinct regions that have different screen opening sizes from each other.

7. The rotary aggregate washing and classification system of claim 6, further comprising at least one rock bin having a top which receives graded material that has passed through said at least one screen mesh, a bottom, and a means to discharge said graded material from said rock bin to a location external to said rotary aggregate washing and classification system.

8. The rotary aggregate washing and classification system of claim 7, further comprising a fluid inlet distal from said rock bin top and a fluid discharge adjacent said rock bin top.

9. The rotary aggregate washing and classification system of claim 8, wherein said fluid inlet is adjacent said rock bin bottom and said rock bin acts as a fluid conduit to receive said fluid at said fluid inlet and to conduct said fluid to said rock bin top to discharge therefrom.

10. The rotary aggregate washing and classification system of claim 1, further comprising at least one baffle dividing a fluid stream within said fluid reservoir between said at least one screen mesh and said sand classifier and thereby controlling fluid flow within said fluid reservoir to initiate classification therein.

11. A rotary aggregate washing and classification system, comprising in combination:

a material inlet for receiving material therein;

a reservoir containing a fluid therein;

at least one screen mesh having at least one screen opening size, and coupled to said material inlet suitably to receive said material therefrom, and passing at least partially through said reservoir, and thereby forming a passage for material smaller than said at least one screen opening size to pass through while material larger than said at least one screen opening size is prevented from passing through, whereby said at least one screen mesh is operative to separate larger material from smaller material;

a sand classifier within said reservoir receiving said smaller material subsequent to said smaller material passing through said at least one screen mesh and cooperative with a decreasing velocity flow within said fluid and said smaller material to gravitationally separate said smaller material into at least two different coarseness increments; and at least one baffle dividing a fluid stream within said fluid reservoir between said at least one screen mesh and said sand classifier and thereby controlling fluid flow within said fluid reservoir to initiate classification therein.

12. The rotary aggregate washing and classification system of claim 11, wherein said at least one screen mesh is tubular and rotates about a screen mesh axis of rotation, and said sand classifier is cooperative with said fluid flow traveling generally parallel to said screen mesh axis of rotation and in a direction aggregate travels within said at least one screen mesh to grade said smaller material into said at least two coarseness increments.

13. The rotary aggregate washing and classification system of claim 11, wherein said at least one screen mesh is tubular and rotates about a screen mesh axis of rotation, and said sand classifier is cooperative with said fluid flow traveling generally parallel to said screen mesh axis of rotation and in a direction opposed to aggregate movement within said at least one screen mesh to grade said smaller material into said at least two coarseness increments.

14. The rotary aggregate washing and classification system of claim 11, wherein said at least one screen mesh is tubular and comprises expanded metal.

15. The rotary aggregate washing and classification system of claim 14, further comprising an auger within said at least one screen mesh which is operative to carry said material against the force of gravity through said at least one screen mesh.

16. The rotary aggregate washing and classification system of claim 14, wherein said at least one screen mesh expanded metal has an irregular surface that is at intervals angularly offset from tangent to a circle concentric about said screen mesh axis of rotation, to more readily pass said smaller material during a lifting of said smaller material than during a lowering of said smaller material.

17. The rotary aggregate washing and classification system of claim 11, wherein said at least one screen mesh comprises at least two distinct regions that have different screen opening sizes from each other.

18. The rotary aggregate washing and classification system of claim 17, further comprising at least one rock bin having a top which receives graded material that has passed through said at least one screen mesh, a bottom, and a means to discharge said graded material from said rock bin to a location external to said rotary aggregate washing and classification system.

19. The rotary aggregate washing and classification system of claim 18, further comprising a fluid inlet distal from said rock bin top and a fluid discharge adjacent said rock bin top.

20. The rotary aggregate washing and classification system of claim 19, wherein said at least one screen mesh is tubular, said fluid inlet is adjacent said rock bin bottom and said rock bin acts as a fluid conduit to receive said fluid at said fluid inlet and to conduct said fluid to said rock bin top to discharge therefrom into an interior of said at least one tubular screen mesh.

* * * * *